US006986438B2

(12) United States Patent
Leung

(10) Patent No.: US 6,986,438 B2
(45) Date of Patent: Jan. 17, 2006

(54) INSULATING SLEEVE

(76) Inventor: Bernard Leung, 403 Roseland Ave., Upper Nyack, New York, NY (US) 10960

( * ) Notice: Subject to any disclaimer, the term of this patent is extended or adjusted under 35 U.S.C. 154(b) by 183 days.

(21) Appl. No.: 10/661,791

(22) Filed: Sep. 12, 2003

(65) Prior Publication Data

US 2005/0056654 A1 Mar. 17, 2005

(51) Int. Cl.
*B65D 25/00* (2006.01)

(52) U.S. Cl. ..... 220/739; 220/737

(58) Field of Classification Search ..... 220/62.12, 220/592.17, 592.24, 676, 737, 738, 739; 493/100; 229/400, 402, 403, 89, 90, 91
See application file for complete search history.

(56) References Cited

U.S. PATENT DOCUMENTS

| | | | | | |
|---|---|---|---|---|---|
| 248,770 | A | * | 10/1881 | Mark et al. | 229/89 |
| 538,699 | A | * | 5/1895 | Redlich | 229/89 |
| 1,866,805 | A | | 7/1932 | Haywood | |
| 2,028,566 | A | | 1/1936 | Seipel et al. | |
| 3,049,277 | A | | 8/1962 | Shappell | |
| 5,259,529 | A | | 11/1993 | Coale | |
| 5,385,260 | A | | 1/1995 | Gatcomb | |
| 5,425,497 | A | | 6/1995 | Sorensen | |
| 5,445,315 | A | * | 8/1995 | Shelby | 229/117.06 |
| 5,454,484 | A | | 10/1995 | Chelossi | |
| 5,826,786 | A | | 10/1998 | Dickert | |
| 5,842,633 | A | | 12/1998 | Nurse | |
| 5,857,615 | A | | 1/1999 | Rose | |
| 6,152,363 | A | | 11/2000 | Rule, Jr. | |
| 6,286,754 | B1 | | 9/2001 | Stier et al. | |
| 6,286,798 | B1 | * | 9/2001 | Chun | 248/311.2 |
| 6,343,735 | B1 | | 2/2002 | Cai | |
| 6,364,151 | B1 | * | 4/2002 | Gale | 220/738 |
| 2003/0111475 | A1 | | 6/2003 | Cheng et al. | |

* cited by examiner

*Primary Examiner*—Nathan J. Newhouse
*Assistant Examiner*—Harry Grosso
(74) *Attorney, Agent, or Firm*—Davidson, Davidson & Kappel, LLC

(57) ABSTRACT

An insulating cup sleeve has a flat, elongated blank with straight top and bottom edges and end edges, and has a plurality of transverse slits that cut into the blank, spaced apart from each other and cut at least partway across the height of the blank, which slits serve to expand the sleeve around the circumference of the cup when the slits are situated along the upward edge of the sleeve. The transverse slits terminate at a larger area cut-out that disperses the tearing pressure at the end of the slit. The new insulating cup sleeve uses about 13.4% less material and takes up about 19.4% less physical space than the prior art sleeve, thus constituting substantial savings on materials and production cost, as well as on transportation and storage.

22 Claims, 11 Drawing Sheets

FIGURE 1 - PRIOR ART
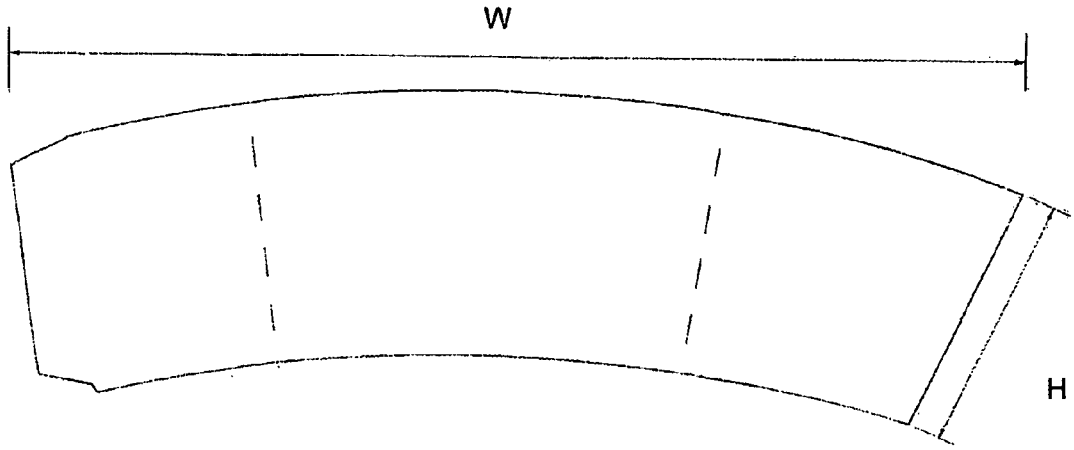
FIGURE 2 - PRIOR ART
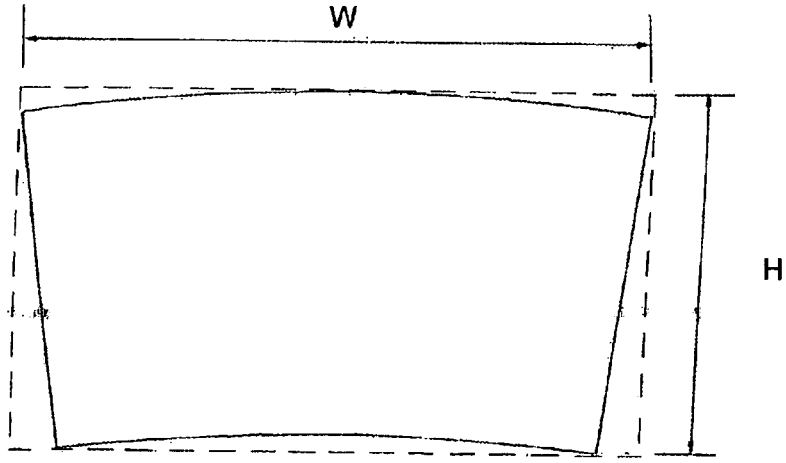
FIGURE 3
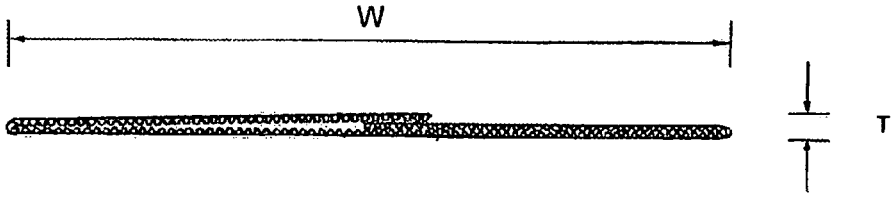

INSULATING SLEEVE

FIELD OF THE INVENTION

This invention relates to a sleeve adapted to be fitted on the outside of a hot beverage cup in order to provide additional insulation for the hot contents of the cup, and, more particularly, to an improved insulating sleeve having a configuration that facilitates efficient manufacturing thereof.

BACKGROUND OF THE INVENTION

Disposable cups are routinely used in fast food and take-out restaurants to contain hot drinks. Such cups are of standardized sizes, normally frusto-conical in shape and having an upwardly open top rim adapted to receive one of several standard sizes of plastic lid. These cups are also generally made from wax-covered paper, paperboard or and polystyrene. While polystyrene is an excellent thermal insulator, it is not easily recyclable or biodegradable and thus has fallen out of favor. On the other hand, paper and paperboard are easily recyclable and biodegradable but are poor thermal insulators. As a result, because cups made from paper and paperboard materials have relatively thin walls, when they are filled with a hot beverage, such as coffee, tea or soup, they are difficult to handle comfortably due to the elevated temperature of the contents of the paper cup.

As a result, many dispensers of such hot drinks "double-cup" the beverage, i.e., use two nested cups instead of a single cup. Double cupping is, of course, very wasteful and increases the burden on the environment.

In an effort to provide adequate insulation for comfortable handling of a paper cup, the art has proposed many versions of an insulating sleeve for holding the cup. These sleeves are frequently made from a paperboard blank that is configured to closely embrace the paper cup and protect the user's fingers from high temperatures. These sleeves, being disposable like the cup itself, still represent a much smaller burden on the environment than does an extra cup.

One such insulating sleeve, disclosed in U.S. Pat. No. 5,425,497 to Sorensen, is made from an arcuate blank or band with oppositely extending slots at the ends, the band being of a sheet material characterized by a plurality of discrete, spaced-apart, approximately hemispherically-shaped depressions covering substantially the entire surface of the band, thus creating a plurality of insulating air gaps between the band and a cup around which the band is placed. Another such sleeve, disclosed in U.S. Pat. No. 5,842,633 to Nurse, is an arcuate band of flexible corrugated material with curved side walls, oppositely extending slots adjacent the ends of the band and tabs lying alongside the slots, the tabs projecting only part-way across the width of the band, to facilitate the setting up of the sleeve.

These configurations suffer from several drawbacks. In order to be used for holding a cup, the flat arcuate band must be rolled into a circle and its notched ends must be interlocked to form a tapered sleeve for holding the cup. This type of cup holder sleeve has the disadvantage that it must be assembled on site by the food service worker or the customer, which can be inconvenient and take additional time during food service. In addition, the need to interlock the notched ends on-site risks possible breakage or improper assembly. Other types of sleeves that also require on-site assembly of opposing ends, such as with a fastener, e.g., a pressure-sensitive strip, have similar disadvantages.

Other configurations have been devised that require no on-site assembly other than changing the configuration of the sleeve from a folded, stored position to an open position. For example, in U.S. Pat. No. 5,454,484 to Chelossi, the insulating sleeve is made from a folded arcuate paper stock blank whose ends have been adhered or glued to each other. This folded sleeve, which expands to an oval or eye like shape by squeezing the folded sleeve at the folds, thereby providing an opening to receive the bottom end of a tapered beverage cup, has become the standard in the field.

These conventional insulating cup holders typically are formed from a paperboard blank, as shown in FIG. 1, having arcuate top and bottom edges. When the ends of the blank have been adhered together, the blank may be folded for storage and shipping, as shown in FIGS. 2 and 3. When the blank is formed into an assembled configuration, the holder forms a tapered sleeve that may be positioned about a tapered container. However, manufacturing of these cup holders is very inefficient. Because of the arcuate top and bottom edges, a large portion of a sheet of material from which the insulating holder blanks are cut remains unused. In addition, the arcuate top and bottom edges lead to nonuniform spacing of the container holder blanks within the sheet of material such that advertising material printed on a sleeve is not predictably centered thereon.

It is therefore desirable to provide an insulating cup sleeve that is pre-assembled to allow its immediate use without taking up any time on site, is made not from an arcuate blank and can be stored flat without any complicated handling.

It is further desirable to provide an insulating cup sleeve that facilitates efficient use of materials and efficient use of storage and shipping space.

SUMMARY OF THE INVENTION

Accordingly, an object of the present invention is to provide an improved insulating cup sleeve that has a unique shape.

Another object of the present invention is to provide an improved insulating cup sleeve that has a shape that facilitates efficient use of materials in manufacturing thereof.

A further object of the present invention is to provide an improved insulating cup sleeve that may be securely fastened around a cup and that, in an unassembled configuration, is easily stacked.

Still another object of the present invention is to provide an improved insulating cup sleeve that, in an unassembled configuration, facilitates efficient use of storage and shipping space.

In accordance with the above objects and others, the present invention provides an improved insulating cup sleeve that has a unique shape, has a shape that facilitates efficient use of materials, may be securely fastened in a circular configuration, may be releasably fastened and that, in an unassembled configuration, is easily stacked, and that, in an unassembled configuration, facilitates efficient use of storage and shipping space.

In a preferred embodiment, the improved insulating cup sleeve is cut from a sheet of material and comprises a flat, elongated blank or band delimited by elongated top and bottom edges and by two short end edges. The top and bottom edges, as well as the two end edges, preferably define straight lines that are parallel to each other and perpendicular to the other edges.

In a preferred embodiment, the insulating cup sleeve also has a plurality of transverse slits that are cut into the blank, spaced apart from each other and extending at least partway across the height of the blank. The number of slits may vary subject to individual's or the retailer's preference. These slits serve to expand the surface area of the sleeve around the circumference of the cup being held within the sleeve. Preferably, when a cup is placed within the sleeve, the sleeve is oriented such that the slits are situated along the upward edge of the sleeve and around the upper and widening region of the frusto-conically shaped cup, whereby the surface area of the sleeve around the slits is able to "expand" to accommodate the widening upper region of the cup.

In a preferred embodiment, in order to prevent the slit from tearing completely across the sleeve, the transverse slits terminate within the sleeve at a larger area cut-out. The presence of the cut-out disperses the tearing pressure at the end of the slit. In one preferred embodiment, the transverse slits terminate in a horizontal cut, such that an inverted T is formed with the slits and the horizontal cut out. This cut-out may have any of a number of other shapes that may be configured according to the interest or business of the particular vendor or retailer for whom the cups are made.

In a preferred embodiment, the blank also has notches at the opposing corners of the top edges of the slits in order to eliminate sharp corners. In a preferred embodiment, the blank further has a small cut out portion, preferably in the shape of a wedge, at the bottom edge of the band immediately below each slit in order to alleviate bulges when the blank is fitted as an insulating sleeve around a cup. The shape of slits, corners cuts, horizontal cuts, and wedge cuts may vary depending on the individual design criteria and specifications.

In a preferred embodiment, the insulating cup sleeve has first and second fold lines that are scored across the blank and that are spaced apart from each other at respective intermediate positions of the blank and of the two side edges of the elongated blank. The opposite ends of the blank are folded at the first and second fold lines such that the first and second side edges overlap each other, and the first and second side edges are adhered together with adhesive applied at the mutually overlapping surfaces. The insulating cup sleeve blank is pre-assembled into a flat-folded form and then can be readied for use simply by squeezing on outside surfaces of the flat-folded blank around the fold lines so as to bow out the blank into an annular sleeve with opened top and bottom ends for inserting a cup therein.

The new insulating cup sleeve uses approximately 13.4% less material than the prior art sleeve and takes up approximately 19.4% less physical space, thus constituting substantial savings on materials and production cost, as well as on transportation and storage.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which:

FIG. 1 shows a blank from which a prior art insulating cup sleeve is made;

FIG. 2 shows a prior art insulating cup sleeve blank in its folded, storage configuration;

FIG. 3 shows a top view of an insulating cup sleeve blank in its folded, storage configuration;

DETAILED DESCRIPTION OF THE INVENTION

Figure 4:
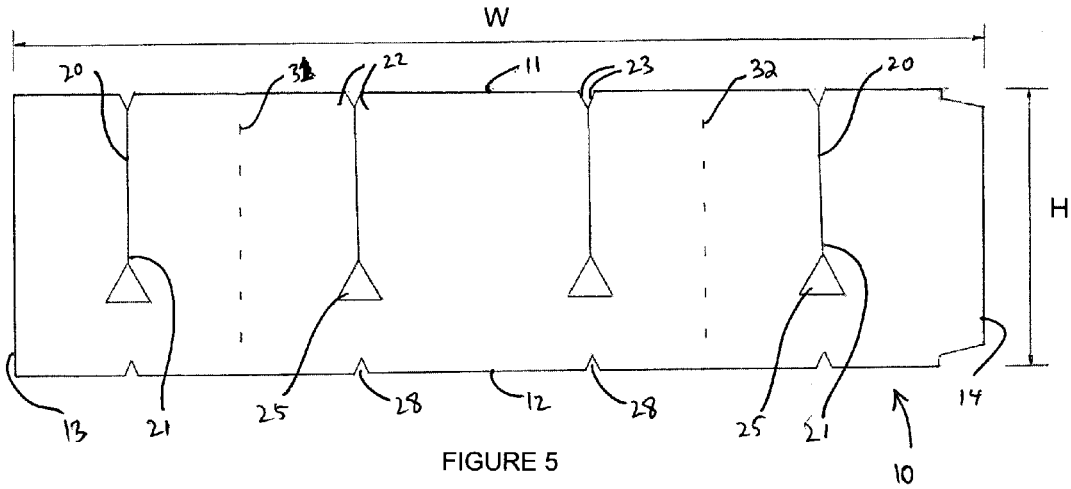
FIG. 4 shows a first embodiment of a blank from which an insulating cup sleeve according to the present invention is made.
Figure 5:
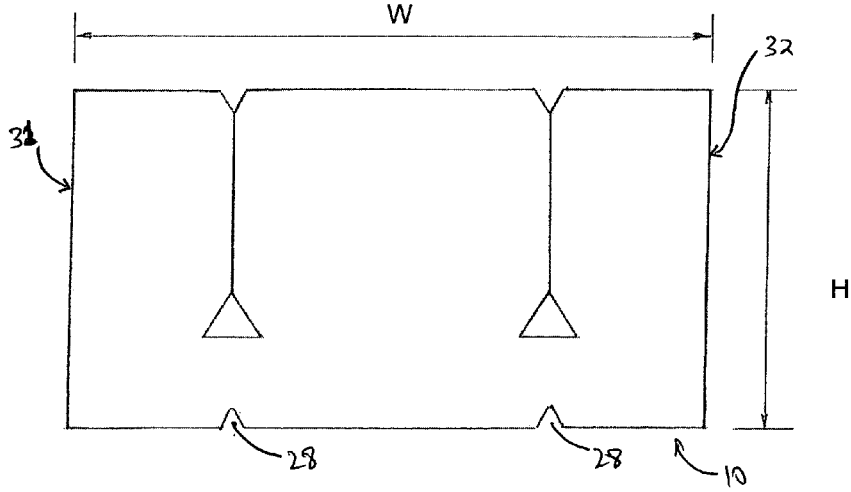
FIG. 5 shows the insulating cup sleeve blank of FIG. 4 in its forded, storage configuration.
Figure 6:
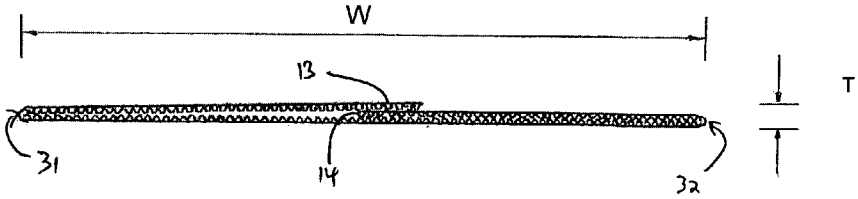
FIG. 6 shows a top view of an insulating cup sleeve blank according to the present invention in its folded, storage configuration.
Figure 7:
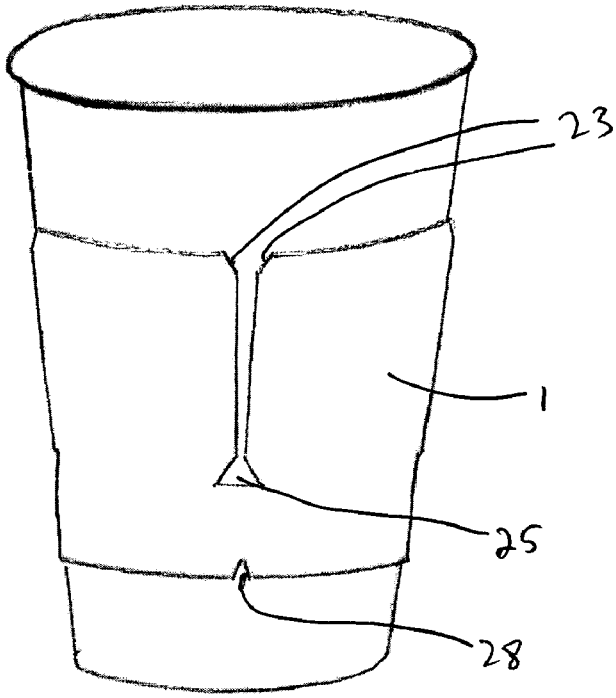
FIG. 7 shows the insulating cup sleeve of FIG. 4 in use around a cup.
Figure 8:
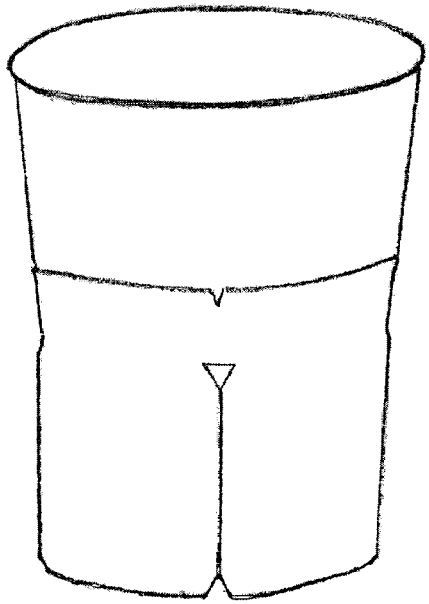
FIG. 8 shows the insulating cup sleeve of FIG. 4 in an alternate use around a cup.
Figure 9A:
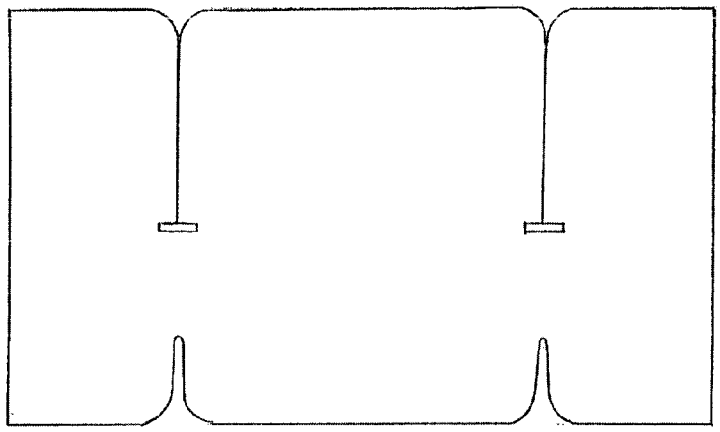
FIGS. 9A–9V show alternative embodiments of the insulating cup sleeve according to the present invention in a folded, storage configuration.
Figure 9B:
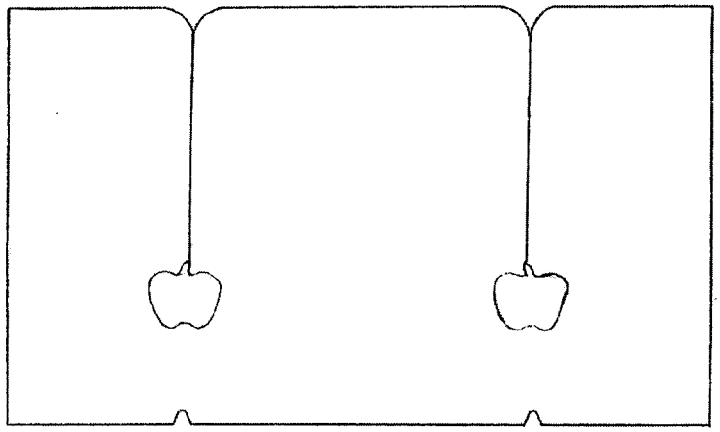
Figure 9C:
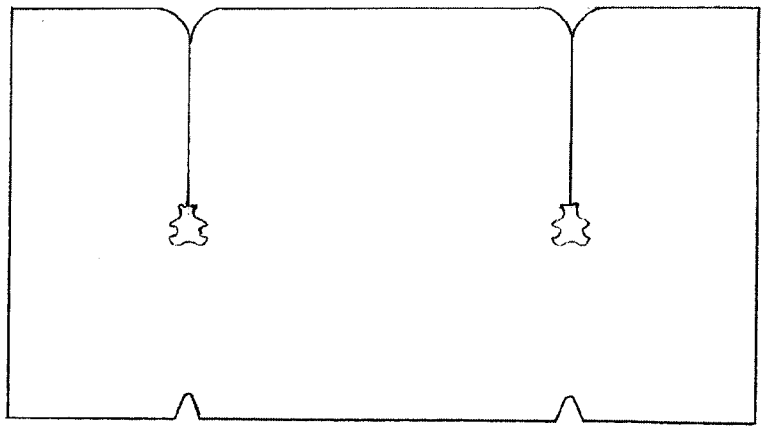
Figure 9D:
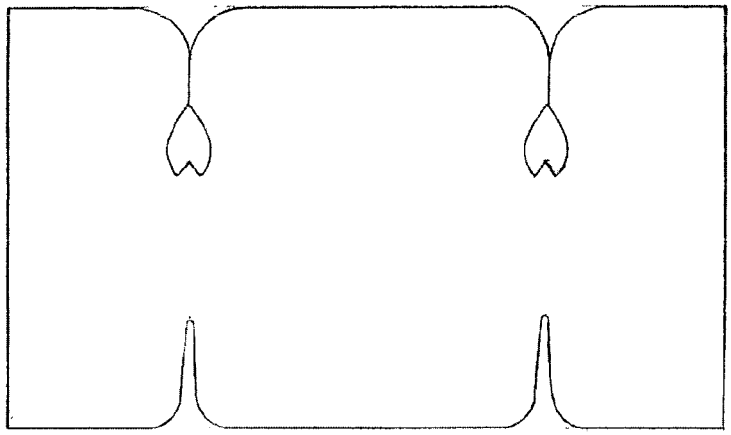
Figure 9E:
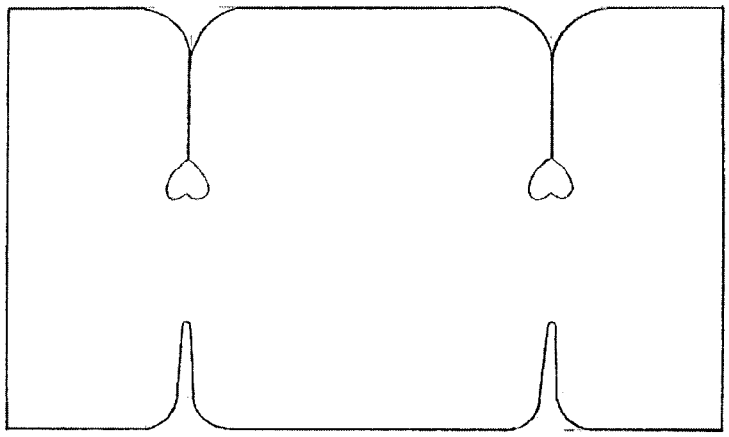
Figure 9F:
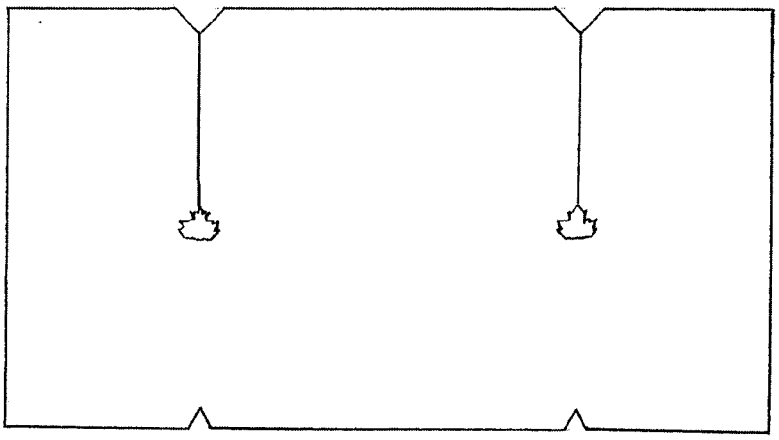
Figure 9G:
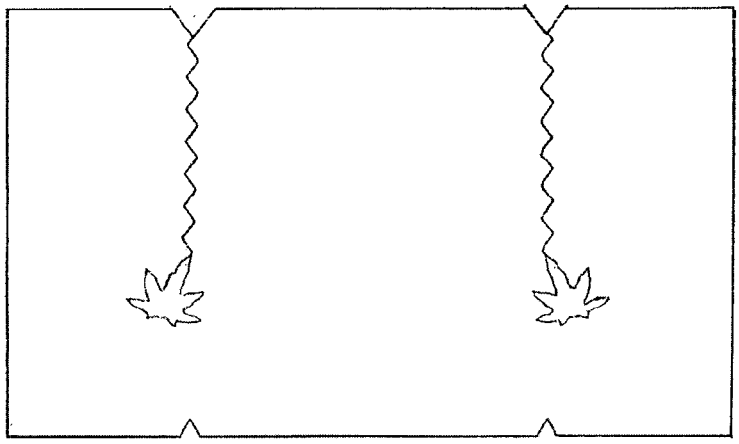
Figure 9H:
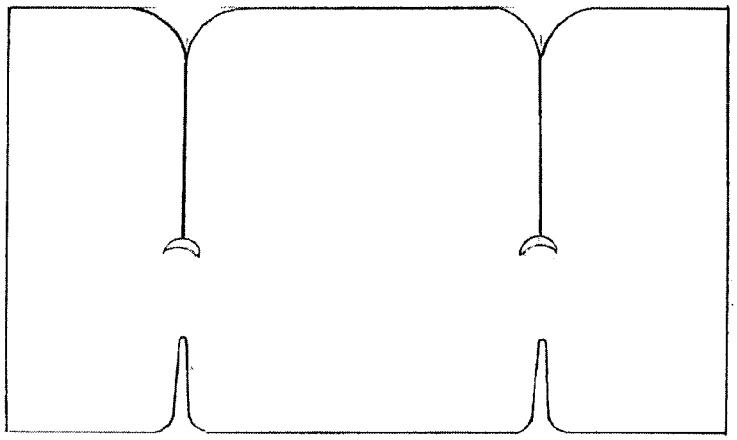
Figure 9I:
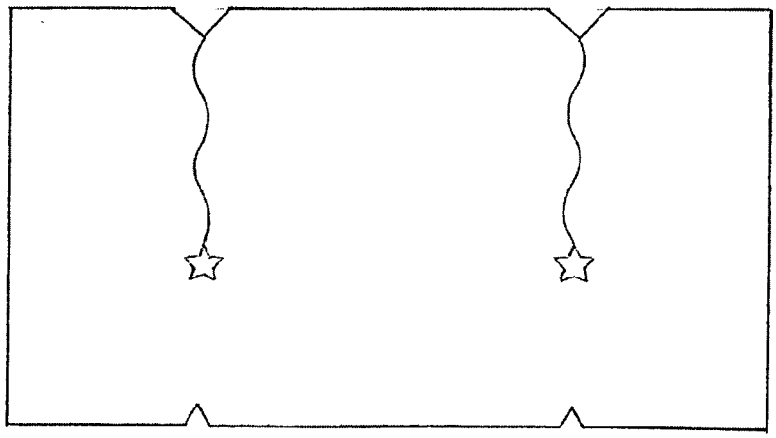
Figure 9J:
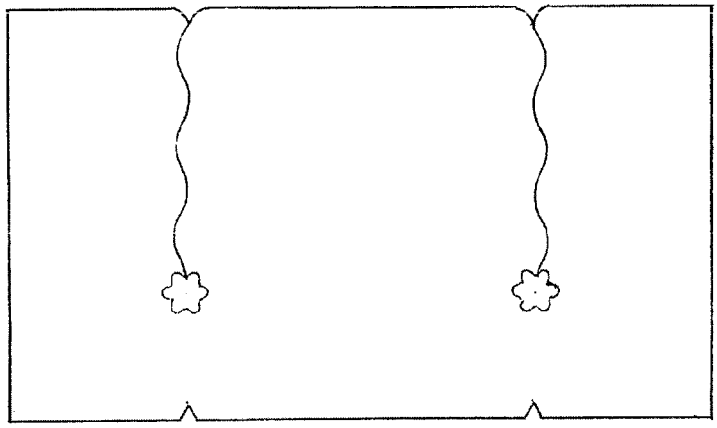
Figure 9K:
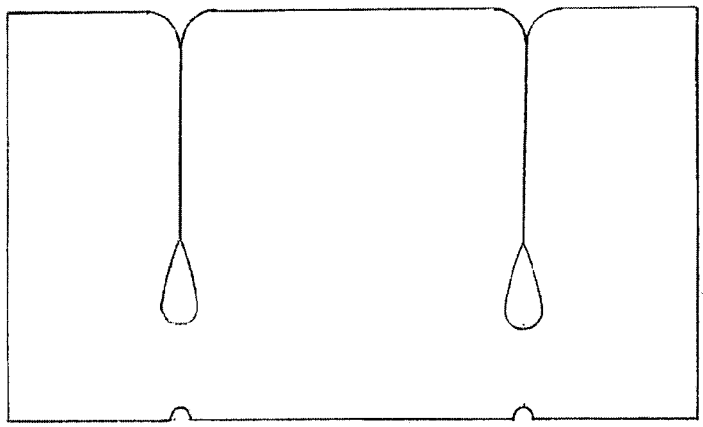
Figure 9L:
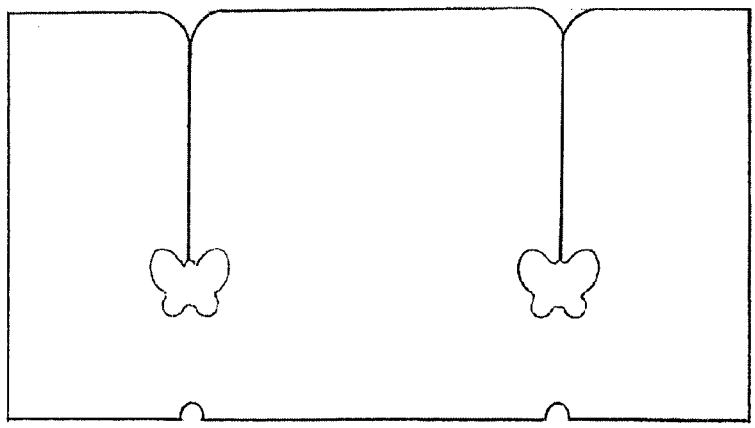
Figure 9M:
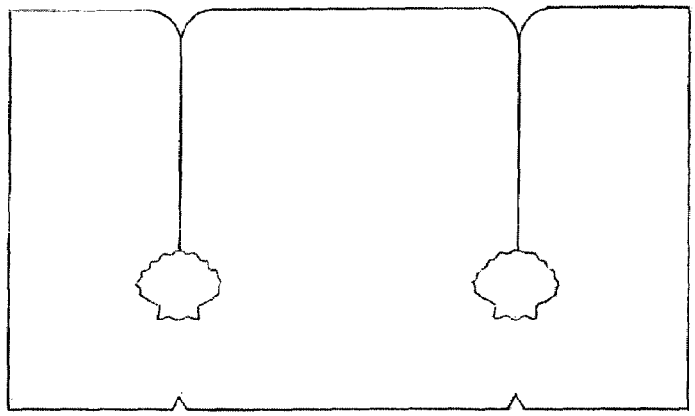
Figure 9N:
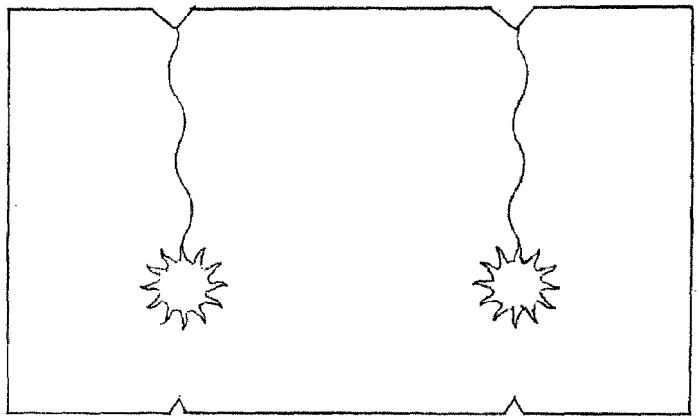
Figure 9O:
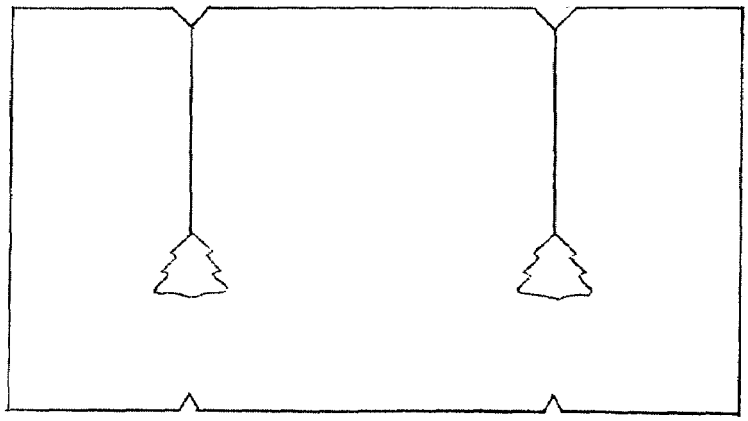
Figure 9P:
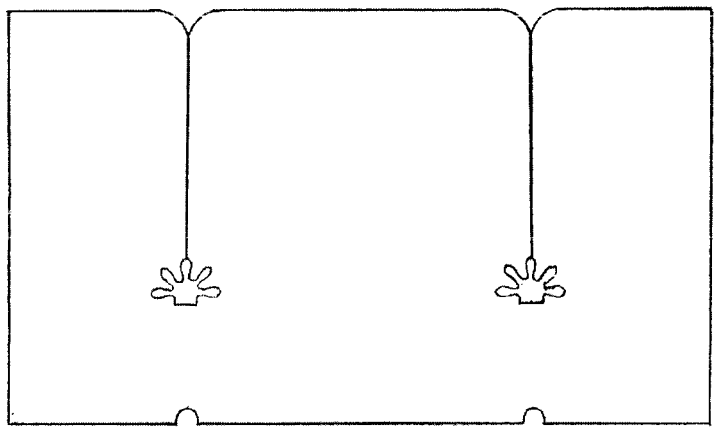
Figure 9Q:
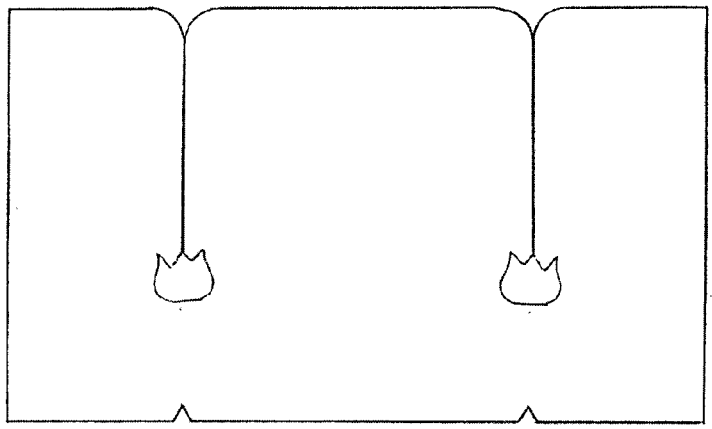
Figure 9R:
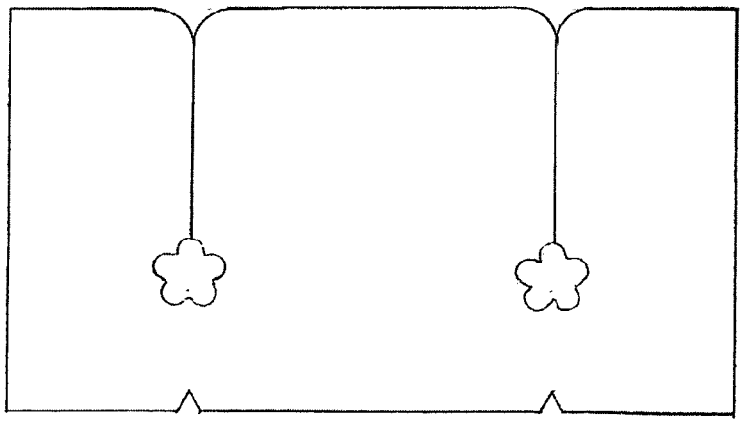
Figure 9S:
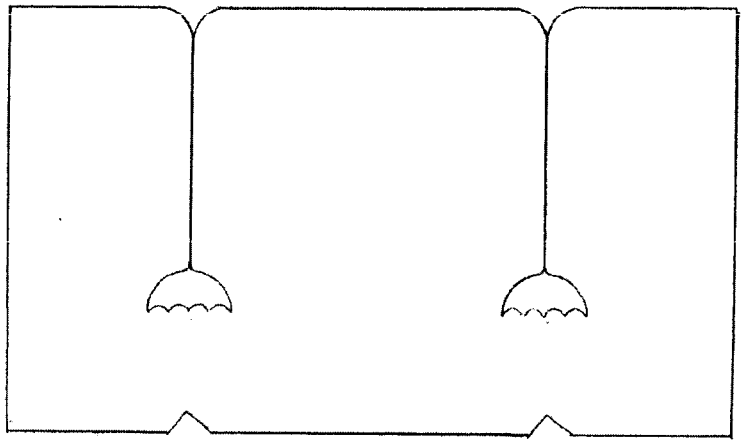
Figure 9T:
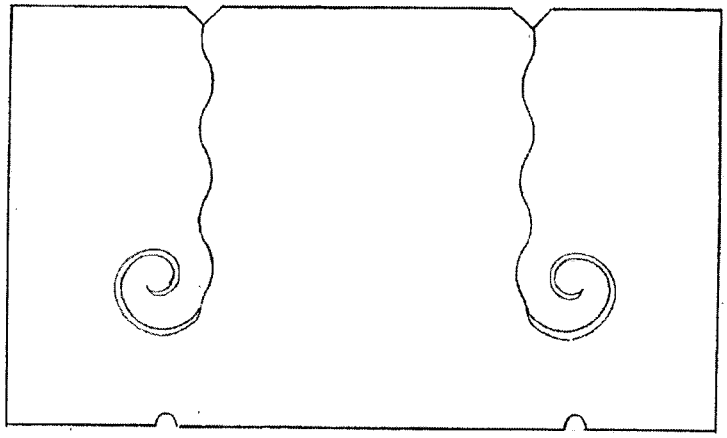
Figure 9U:
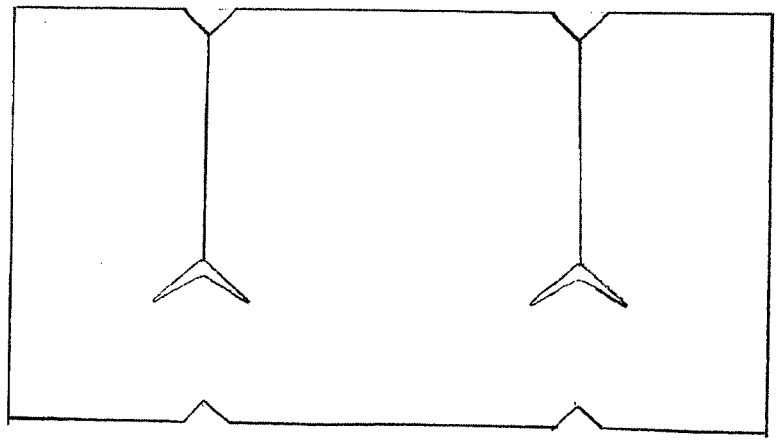
Figure 9V:
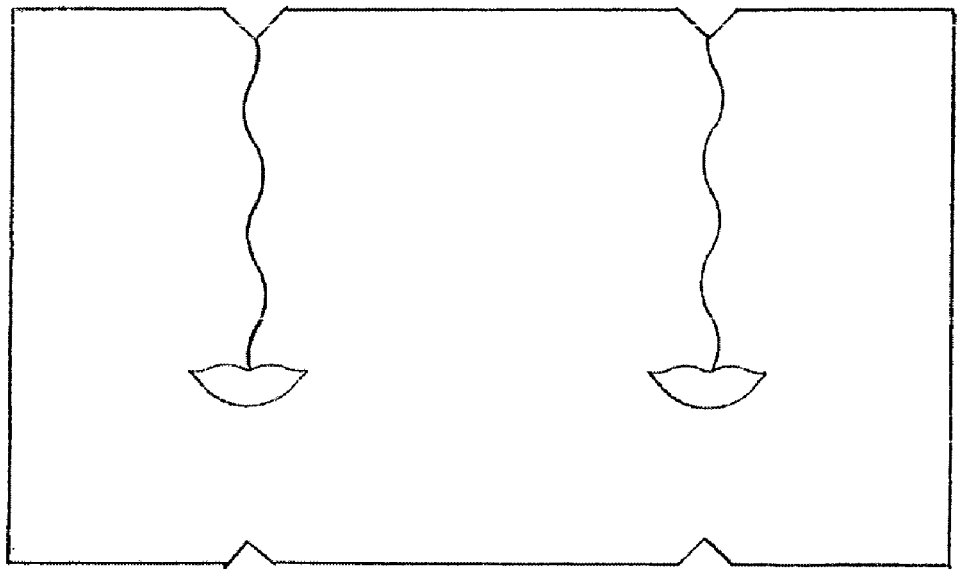

The present invention provides an insulating cup sleeve, as shown in FIGS. 4–9V. As described below, FIG. 4 depicts a first embodiment of a blank or band in a flattened and open shape, which is then formed into a flattened and folded shape as shown in FIGS. 5 and 6 for storage and shipping, and then formed into an annular shape and mounted about a cup, as depicted in FIGS. 7 and 8. Alternative embodiments of the insulating cup sleeve are depicted in FIGS. 9A–9V.

As shown in FIGS. 4–7, an insulating sleeve 1 made in accordance with the present invention is formed from an elongated blank or band 10. Blank 10 is constituted of a paper material, preferably corrugated board, paperboard or heavy weight paper, such as cardboard, so as to render the insulating sleeve rigid, for example to be able to support a cup filled with a beverage, and so that the insulating sleeve is reusable and recyclable. Single- or double-face corrugated paper having one or two liners adhered to one or both sides of a fluted sheet may also be used, so as to make the sleeve insulative, and the liner may be adhered to the fluted sheet by a variety of adhesives, such as biodegradable glue.

Blank 10 has an elongate shape, with a top edge 11, a bottom edge 12, a first end edge 13 and a second end edge 14. Opposing top and bottom edges 11 and 12 are generally elongated, straight and parallel to each other. Similarly, opposing first and second end edges 13 and 14 are also generally short, straight and parallel to each other. Furthermore, opposing first and second end edges 13 and 14 are also remote from each other, and each extends generally perpendicularly to the adjacent parts of the top and bottom edges 11 and 12. In one preferred embodiment, blank 10 is approximately 200 mm to approximately 260 mm in width, and approximately 60 mm to approximately 75 mm in height. In a further preferred embodiment, blank 10 is approximately 232 mm in width and approximately 67 mm in height.

In a preferred embodiment, the insulating cup sleeve blank 10 also has a plurality of transverse slits 20 cut therein. Slits 20 serve to expand the surface of the insulating sleeve 1 around the circumference of the cup being held, as can be seen in FIG. 7. Slits 20 may be straight line cuts or may be curved or wavy.

Slits 20 are formed preferably at least partway across the height of blank 10, which is measured as the distance between top and bottom edges 11 and 12. It is preferred that slits 20 be formed from top edge 11 of blank 10, such that slits 20 allow the cup holder to spread around the mouth of a cup, as shown in FIG. 7. Alternatively, slits 20 can be formed from bottom edge 12 of blank 10, such that slits 20 extend downward away from the mouth of a cup, as shown in FIG. 8. Slits 20 are cut into blank 10 preferably in a direction perpendicular to the cut edge (either top 11 or bottom 12 edge), but could be cut alternatively at another angle relative to the edge 11 or 12 of blank 10

As discussed below, the farther across the height of blank 10 slits 20 are cut, the more of a spread slits 20 will have and the wider a cup mouth the insulating sleeve 1 will be able to accommodate, as can be seen in FIG. 7. In a preferred embodiment, slits 20 are formed from about one-half to about four-fifths of the way across the height of blank 10, although in certain embodiments, slits 20 may be formed less than one-half, even as much as one-fourth or one-third, and more than four-fifths of the way across the height of blank 10.

Slits 20 are spaced apart from each other along the width of blank 10, measured as the distance between first and second end edges 13 and 14. It is preferred that slits 20 be evenly spaced apart from each other along the width of blank 10, although they may be unevenly spread, if desired. The number of slits 20 may vary subject to individual's preference, although the more slits 20 there are along the width of blank 10, the more closely the outside shape of the insulating sleeve 1 will match and conform to the contour of the cup being held. In a preferred embodiment, blank 10 has anywhere from two to six slits 20 cut therein. Most preferably, for use with a standard size a standard size 8, 12 or 16 oz., beverage cup popularly available in today's market-place, blank 10 has four slits 20 cut therein. In an alternative embodiment, blank 10 could have fewer than two or more than six slits 20, depending upon the desired design of blank 10 or the size of the cup to be insulated, such that a larger cup, and more specifically a cup with a wider mouth, would require more slits in order to best surround the circumference thereof.

As the cup is forced deeper into the insulating sleeve 1, as shown in FIG. 7, slits 20 are forced farther apart horizontally (or circumferentially), creating a hoop stress around the circumference of sleeve 1, which is manifested in the form of a tearing pressure at the ends 21 of slits 20 that tends to further tear slit 20 across the width of blank 10. Accordingly, in a preferred embodiment, transverse slits 20 terminate within the height of blank 10 with a further cut-out 25 formed within blank 10. Cut-out 25 serves to disperse the tearing pressure at the end of slit 20 in order to prevent slit 20 from being torn further across the height of blank 10. In one preferred embodiment, as shown in FIG. 9A, slits 20 terminate in a horizontal cut-out, such that an inverted T-shape is formed with each slit 20 and horizontal cut-out.

Cut-out 25 may have any of a number of other shapes, which may be configured according to the interest or business of the particular vendor or retailer for whom the cups are made. For example, cut-out 25 may be a triangle, as shown in FIGS. 4–5, or any other geometric shape, such as a circle, oval, square, rectangle, diamond, etc. In addition, any of the following shapes may also be used for cut-out 25: apple (FIG. 9B), teddy bear (FIG. 9C) or other animal, flame (FIG. 9D), heart (FIG. 9E), leaf (FIG. 9F and 9G), moon or crescent (FIG. 9H), star (FIG. 91), vinca (FIG. 9J), droplet (or tear drop) (FIG. 9K), butterfly (FIG. 9L), shell (FIG. 9M), sun (FIG. 9N), tree (FIG. 9O), flower (FIG. 9P, 9Q and 9R), umbrella (FIG. 9S), spiral (FIG. 9T), arrowhead (FIG. 9U), lips (FIG. 9V), as well as any other conceivable shape. Cut-out 25 should be such that it disperses outward the tearing pressure that extends downward along slits 20, due to the circumferential spreading pressure of the cup within insulating sleeve 1. Cut-out 25 may be longer or smaller than those depicted in the drawings, as necessary to accomplish the stated purpose.

In a preferred embodiment, the corners 22 of blank 10 where slits 20 meet upper edge 11 (or lower edge 12) have notches or rounded edges 23 in order to eliminate sharp corners. Notches (as shown in FIGS. 4 and 5) or rounded edges 23 (as shown in FIGS. 9A–C) are important because, as the circumferential spreading pressure of the cup spreads slits 20 of insulating sleeve 1, as shown in FIG. 7, corners 22 will protrude. Should corners 22 be sharp, they could hurt a user, especially given the thickness of blank 10. Notches or rounded edges 23 provide a safety feature against any such injuries that may be caused.

As the cup is forced deeper into the insulating sleeve 1, as shown in FIG. 7, and slits 20 are forced farther apart horizontally (or circumferentially), bulges will be formed at bottom edge 12 of sleeve 1 immediately below slits 20. In order to eliminate or reduce the incidence of these bulges, blank 10 preferably also has a small cut-out portion 28 along bottom edge 12 of blank 10 immediately opposite each slit 20. Cut-out portions 28 are preferably in the shape of a wedge, as shown in FIGS. 4 and 5, but could vary in shape, such as by being more elongated (as shown in FIGS. 9A, 9D and 9H), rounded (as shown in FIGS. 9E and 9L) or wide (as shown in FIGS. 9S and 9U), according to desired design criteria and specifications. Cut-out portions 28 should alleviate or reduce bulges that are formed at bottom edge 12 when blank 10 is fitted as an insulating sleeve 1 around a cup.

In a preferred embodiment, blank 10 also has first and second fold lines 31, 32 that are scored, slit cut, or perforated into the material of blank 10. Fold lines 31, 32 are spaced apart from each other at respective intermediate positions of blank 10 and at respective positions intermediate of first and second side edges 13, 14.

Insulating sleeve blank 10 is pre-assembled into a flat-folded form, as shown in FIGS. 2–3 and 5–6. The opposite ends of blank 10, which are defined by first and second side edges 13, 14, are folded flat at the first and second fold lines 31, 32, respectively, such that first and second side edges 13, 14 overlap each other. Overlapping first and second side edges 13, 14 can then be affixed together by any suitable means, such as with adhesive applied at the mutually overlapping surfaces. The resulting insulating cup sleeve 1 is thus pre-assembled in a flat-folded form for compact storage and convenient handling. In a preferred embodiment, insulating sleeve, in its folded configuration as shown in top view in FIG. 6, has a thickness of approximately 3 mm.

The stiffness of the stock of blank 10 keeps insulating sleeve 1 in folded shape until it is selected for use. The insulating sleeve is quickly and conveniently readied for use by applying pressure toward the center of the folded blank 10 on the outside edges thereof (as shown in FIG. 5) around the first and second fold lines 31, 32. By this pressure, blank 10 is bowed out into an annular sleeve, i.e., insulating sleeve 1, with opened top and bottom ends. As soon as the width at the upper end of the opened insulating sleeve 1 is larger than the diameter at the bottom of the cup, the bottom of the cup can be inserted into the sleeve and forced downward. Releasing the squeezing force clamps the cup in the sleeve, without the sleeve being fully expanded to a circular cross-section needed for complete compliance with the shape of the beverage cup.

FIG. 7 is a perspective side and top view of the insulating sleeve of the present invention mounted on a frusto-conically shaped cup, i.e., a cup having including an open top end, tapered circumferential side wall, and a closed bottom end. The cup is frictionally secured within the insulating cup sleeve 1 by inserting the cup through the opened upper end of insulating sleeve 1 and press fitting the cup therein. Slits 20 serve to expand the surface of the insulating sleeve 1 around the circumference of the cup. Preferably, when a cup is placed within sleeve 1, sleeve 1 is oriented such that slits 20 are situated along the upward edge of the sleeve and around the upper and widening region of the cup, whereby the opened upper end of insulating sleeve 1 around the slits is able to "expand" or fan out to accommodate the widening circumference of the upward region of the cup. Cut-outs 25 at the terminal points of slits 20 serve to disperse the tearing pressure at the ends 21 of slits 20 in order to prevent slits 20 from being torn further across the height of blank 10. It should be noted that sleeve 1 may be used with any size cup for the purpose of insulating it. Thus, the size and dimensions of blank 10, as well as the size and number of slits 20, cut-outs 25, notches or rounded edges 23, and edge cut out portions 28, may be changed to suit the larger or smaller dimensions of the cup that sleeve 1 is to insulate, without departing from the inventive features of the sleeve.

It should be noted that the construction of the insulating sleeve 1 of the present invention leads to considerable efficiency and cost savings in paper materials and production cost, as well as considerable savings in transportation and storage. Consider, for example, the typical prior art insulating sleeve in current use as shown in FIG. 1, as compared to the inventive insulating sleeve 1 as shown in FIG. 4. In this comparison, the prior art sleeve and the inventive sleeve 1 are appropriately dimensioned to hold and insulate a common-sized 8 oz. coffee cup.

The insulating sleeve blank of the present invention achieves significant savings in material over that of the prior art. The prior art insulating sleeve blank shown in FIG. 1, dimensioned to hold and insulate a common-sized 8 oz. coffee cup, measures approximately 268 mm in width W, approximately 67 mm in height H and approximately 1 mm in thickness T, such that the total volume of material used in the prior art insulating sleeve design is approximately 17,956 $mm^3$ (=268 mm×67 mm×1 mm) (because of the arcuate design, material from certain corner areas must be discarded). By contrast, the insulating sleeve blank 10 of the present invention, as shown in FIG. 4, dimensioned to hold and insulate a common-sized 8 oz. coffee cup, measures approximately 232 mm in width W, approximately 67 mm in height H and approximately 1 mm in thickness T, such that the total volume of material used in the inventive insulating sleeve design is approximately 15,544 $mm^3$ (=232 mm×67 mm×1 mm). This reduction from approximately 17,956 $mm^3$ to approximately 15,544 $mm^3$ in volume represents an approximate cost savings of 13.4% in material. For manufacturers of such items, such a reduction in amount of material used is a significant savings.

The insulating sleeve blank of the present invention also achieves superior efficiency in use of raw materials over that of the prior art, thereby resulting in less waste. When the prior art blank of FIG. 1 is cut from elongated rectangular sheets of material, the arcuate shape of the blank results in many portions of the sheets of material being wasted. This is because the prior art blanks cannot, owing to their arcuate edges, be cut too close to one another. As a result, the material between cut-out blanks remains as very costly waste. By contrast, all edges on the inventive blank 10 of FIG. 4 are straight, such that blanks 10 can be cut adjacent to one another from the raw material sheet, resulting in no waste between the blanks 10 at all.

Similarly, the insulating sleeve blank of the present invention achieves significant savings in transportation and storage costs over that of the prior art. The prior art insulating sleeve blank shown in FIG. 1 dimensioned to hold and insulate a common-sized 8 oz. coffee cup, when folded for transportation or storage as shown in FIG. 2, measures approximately 127 mm in width W, approximately 72 mm in height H and approximately 3 mm in thickness T (as shown in FIG. 3), such that the total volume occupied by each such folded prior art insulating sleeve is approximately 27,432 $mm^3$ (=127 mm×72 mm×3 mm). By contrast, the insulating sleeve blank 10 of the present invention dimensioned to hold and insulate a common-sized 8 oz. coffee cup, as shown in FIG. 4, when folded for transportation or storage as shown in FIG. 5, measures approximately 110 mm in width W, approximately 67 mm in height H and approximately 3 mm in thickness T (as shown in FIG. 6), such that the total volume occupied by each such folded insulating sleeve 10 is approximately 22,110 $mm^3$ (=110 mm×67 mm×3 mm). This reduction from approximately 27,432 $mm^3$ to approximately 22,110 $mm^3$ in volume represents a savings of approximately 19.4% in volume. For those who transport and those who store of such items, such a reduction in volume occupied is a significant savings.

There is also savings in the cost of transportation as a result of the reduction in the amount of material used for each sleeve. Typically, costs of transportation are related to the weight of the items shipped, and the weight of each item shipped directly correlates to the amount of material used for each item. As discussed above, insulating sleeve blank 10 of the present invention uses approximately 13.4% less material than the prior art insulating sleeve. Therefore, insulating sleeve blank 10 of the present invention should weigh approximately 13.4% less than the prior art insulating sleeve. Since a great many sleeves are typically shipped at one time, this approximately 13.4% reduction in weight of each sleeve translates into significant savings in the cost of shipping.

Furthermore, the design of the insulating sleeve of the present invention is more environmentally friendly than that of the prior art design. Because the design of the insulating sleeve of the present invention uses approximately 13.4% less material than does the prior art design, there is thus 13.4% less material to be discarded or to be recycled. In addition, when compared with "double cupping", the design of the insulating sleeve of the present invention uses approximately 52% (vs. approximately 45% by the prior art design) less material than a second paper cup for heat insulating purposes. Moreover, as discussed above, because of the more efficient use of materials in making the blanks 10 for the current invention, the prior art design results in significant waste of raw materials, in contrast to the inventive design, which results in no or an insignificant waste of raw materials.

Thus, an insulating sleeve has been provided. One skilled in the art will appreciate that the present invention can be practiced by other than the described embodiments, which are presented for purposes of illustration and not limitation.

What is claimed is:

1. An insulating sleeve for encircling a frusto-conical container having an open wider end located at the top of said container, comprising:

an elongate body having elongated and substantially straight top and bottom edges and first and second end edges, said body being substantially flat when said elongate body is in an unassembled configuration and said body being in a substantially cylindrical when said elongate body is in an assembled configuration with said first and second end edges fastened to each other, said body in an assembled configuration defining an annular sleeve with top and bottom openings for receiving said container therein; and a plurality of slits cut at least partway across said body from said top edge of said body each slit comprising an entry point at said top edge of said body and a terminal point at least partway across said body;

said cut out region having a width greater than the width of said slit;

a cut out region within said body at said terminal point of each slit;

whereby, when said container is inserted into said sleeve through said top opening, said slits allow said top edge of said annular sleeve to spread such that said annular sleeve at least partially conforms to said container's frusto-conical shape, and whereby said cut out region serves to spread tearing pressure caused by hoop stress on said sleeve caused by insertion of said container within said sleeve.

2. The insulating sleeve of claim 1, wherein said slits are cut in a direction generally perpendicular to said top and bottom edges.

3. The insulating sleeve of claim 1, wherein said slits are cut from about one-half to about four-fifths of the way across said body.

4. The insulating sleeve of claim 1, wherein said cut out region is in a shape chosen from a horizontal line, triangle, circle, oval, square, rectangle, diamond, apple, teddy bear or animal, flame, heart, leaf, crescent, star, vinca, droplet, butterfly, shell, sun, tree, flower, umbrella, spiral, arrowhead and lips.

5. The insulating sleeve of claim 1, further comprising first and second fold lines that are scored across said body and spaced apart from each other at respective intermediate positions of said body, whereby said body can be changed from an unassembled configuration to a folded assembled configuration by folding said first and second edges of said body at said first and second fold lines, respectively, such that the first and second edges overlap each other, and by fastening said first and second edges together to form a folded sleeve.

6. The insulating sleeve of claim 5, wherein said folded sleeve is changed from a folded assembled configuration to an open assembled configuration by squeezing on outside surfaces of the folded sleeve around said fold lines so as shape said folded sleeve into an annular sleeve with top and bottom openings for inserting a container therein.

7. The insulating sleeve of claim 1, wherein said slits number from two to six.

8. The insulating sleeve of claim 1, further comprising a cut out portion at said bottom edge of said body directly opposite said body from each said slit.

9. The insulating sleeve of claim 1, further comprising a notch or rounded edge at each corner formed on said body where each slit meets said upper edge.

10. The insulating sleeve of claim 1, wherein said body is formed from thermally insulating paper material stock.

11. An insulating holder for encircling a container having a conical section whose open wider end is located towards the top of said container, said holder providing thermal protection to the hand of a user holding said container and comprising:

an elongated and thermally insulating blank having substantially straight and substantially parallel top and bottom edges and left and right end edges; and a plurality of slits cut from said top edge at least partway across said blank in the direction of said bottom edge, each slit comprising an entry point at said top edge of said blank and a terminal point at least partway across said blank;

a cut out region within said blank at said terminal point of each slit, said cut out region having a width greater than the width of said slit;

said blank being assembled into a substantially cylindrical configuration when said left and right end edges are fastened to each other so as to define an annular holder with top and bottom openings, whereby, when said container is inserted into said annular holder through said top opening, said slits allow said annular holder to at least partially conform to said conical section of said container, whereby said cut out region serves to spread tearing pressure caused by hoop stress on said holder caused by insertion of said container within said holder.

12. The insulating holder of claim 11, wherein each slit is cut in a direction generally perpendicular to said top and bottom edges.

13. The insulating holder of claim 11, wherein each slit is cut from about one-half to about four-fifths across said blank.

14. The insulating holder of claim 11, wherein said cut out region is in a shape chosen from a horizontal line, triangle, circle, oval, square, rectangle, diamond, apple, teddy bear or animal, flame, heart, leaf, crescent, star, vinca, droplet, butterfly, shell, sun, tree, flower, umbrella, spiral, arrowhead and lips.

15. The insulating holder of claim 11, further comprising a cut out portion at said bottom edge directly opposite said blank from each slit.

16. The insulating holder of claim 11, further comprising left and right fold lines across said blank spaced apart from each other at respective intermediate positions of said blank, whereby said holder can be changed from a flat, unassembled configuration to a folded assembled configuration by folding left and right edges of said blank at said left and right fold lines, respectively, such that left and right edges overlap to form a tri-folded blank, and by fastening said left and right edges together.

17. The insulating holder of claim 16, wherein said holder is changed from a folded, assembled configuration to a substantially cylindrical, assembled configuration when said fastened tri-folded blank is squeezed with an inwardly directed force about said fold lines so as shape said tri-folded blank into an annular holder with top and bottom openings for inserting a container therein.

18. The insulating holder of claim 11, further comprising a notch or rounded edge at each corner formed on said body where each slit meets said upper edge.

19. An insulating holder for a container having annular side wall bounding an interior that widens in cross-section from a closed bottom end to an open top end, said holder comprising:

an annular body circumferentially surrounding the side wall about an axis, said body having top and bottom edges, a plurality of cuts extending from said top edge at least partway across said body in the direction of said bottom edge, each cut comprising an entry point at said top edge of said body and a terminal point at least partway across said body, a cut out region within said body at said terminal point of each cut, said cut out region having a width greater than the width of said cut, and a diameter larger than a diameter of the bottom end of the container and smaller than a diameter of the top end of the container to enable the annular body to constrictingly engage the container side wall;

whereby, when said container is inserted into said annular body, a bottom region of said annular body constrictingly engages the container side wall and a cut top region of said annular body fans out around the circumference of the widened cross-section of said container top end.

whereby said cut out region serves to spread tearing pressure caused by hoop stress on said annular body caused by insertion of said container within said annular body.

20. The insulating holder of claim 19, wherein each cut is from about one-half to about four-fifths across said body.

21. The insulating holder of claim 19, wherein said cut out region is in a shape chosen from a horizontal line, triangle, circle, oval, square, rectangle, diamond, apple, teddy bear or animal, flame, heart, leaf, crescent, star, vinca, droplet, butterfly, shell, sun, tree, flower, umbrella, spiral, arrowhead and lips.

22. The insulating holder of claim 19, further comprising fold lines formed substantially opposing locations across said annular body, such that said holder may be compactly folded for storage or shipping, and said folded holder may be unfolded by being squeezed with an inwardly directed force about said fold lines.

* * * * *